US005973653A

United States Patent [19]

Kragalott et al.

[11] Patent Number: 5,973,653

[45] Date of Patent: Oct. 26, 1999

[54] INLINE COAXIAL BALUN-FED ULTRAWIDEBAND CORNU FLARED HORN ANTENNA

[75] Inventors: Mark Kragalott, Alexandria; William Pala, Fairfax Station, both of Va.

[73] Assignee: The United States of America as represented by the Secretary of the Navy, Washington, D.C.

[21] Appl. No.: 08/904,275

[22] Filed: Jul. 31, 1997

[51] Int. Cl.[6] ..... H01Q 13/00; H01Q 13/02

[52] U.S. Cl. ..... 343/786; 343/772; 343/767; 343/783

[58] Field of Search ..... 343/786, 767, 343/772, 783; H01Q 13/00, 13/02

[56] References Cited

U.S. PATENT DOCUMENTS

| | | | |
|---|---|---|---|
| 4,878,061 | 10/1989 | Nusair et al. | 343/786 |
| 5,428,364 | 6/1995 | Lee et al. | 343/767 |

OTHER PUBLICATIONS

Janaswamy, "An Accurate Moment Method For The Taper Slot Antenna", IEEE Trans. Ant., Prop., vol. No. 12., pp. 1523–1528, Dec. 1989.

Vollmer et al., Synthesis Method For Broadband Tapered Wire Antennas and Its Experimental Verification, IEEE Trans. Ant. and Prop., vol. 37, No. 8, pp. 954–965, Aug. 1989.

Maloney et al., "Accurate Computation of The Radiation From Simple Antennas Using The Finite–Defference Time–Domain Method", IEEE Trans, Ant. and Prop., vol. 38, No. 7, pp. 1059–1068, Jul. 1990.

Janaswamy et al., Analysis of The Tapered Slot Antenna, IEEE Trans. Ant. and Prop, vol. AP–35, No. 9, pp. 1058–1065, Sep. 1987.

Lai et al., A Novel Antenna For Ultra–Wide–Band Applications, IEEE Trans. Ant. Ant. and Prop, vol. 40, No. 7, Jul. 1992.

Luebberg et al., "FDTD Calculation of Radiation Patterns, Impedance", and, Gain for a Monopole antenna on a Conducting Box, IEEE Trans. Ant. and Prop., vol. 40, No. 12, pp. 1577–1583, Dec. 1992.

Shlager et al., "Optimization of Bow–Tie Antennas For Pulse Radiation", IEEE Trans., Ant. and Prop., vol. 42, No. 7, pp. 975–982, Jul. 1994.

Jahnke et al., Tables of Higher Functions, F: Losch (ed), pp. 28–30–, 6th ed., 1960.

Robertson et al., "Ultra–Wide–Band Impulse Antennas Study and Prototype Design", Nav. Post. Grad., Sch. NPSEC–93–010, 1993.

Lames dorf et al., "Baseband Pulse Antenna Techniques", IEEE Ant. & Prop. Mag., vol. 36, pp. 22–30–, Feb. 1994.

Yee, Numerical Solution of Initial Boundary Value Problems Involving Maxwell's Equation In Isotropic Media, IEEE Ant. Prop., vol. 14, pp. 302–307, May 1966.

Kraus, "Antennas", McGraw–Hill, New York NY, 2nd Ed., 1988.

*Primary Examiner*—Frank G. Font
*Assistant Examiner*—Layla Lauchman
*Attorney, Agent, or Firm*—Thomas E. McDonnell; Charles J. Stockstill

[57] ABSTRACT

The inline coaxial balun fed cornu flared horn antenna is formed by transitioning a coaxial transmission line to a parallel-plate transmission line with a Klopfenstein impedance profile and terminating with a flared horn antenna based on a scaled cornu spiral. The cornu spiral is a mathematical plane curve formed by parametrically plotting the scaled cosine Fresnel integral versus the scaled sine Fresnel integral. The antenna has the property that the curvature of the flare increases linearly in proportion to the arc length of the flare. The Klopfenstein impedance profile of the inline balun ensures a low voltage reflection across a wide bandwidth with a minimum transition length and together with the cornu flare satisfies the requirements for a wideband design. The design efficiently radiates and receives a high power pulse of ultrawideband electromagnetic waves over a preferred range of angles in space and transmits a field that is nearly the scaled temporal derivative of the input voltage signal and receives a voltage that is nearly the scaled replica of the incident field.

9 Claims, 3 Drawing Sheets

INLINE COAXIAL BALUN-FED ULTRAWIDEBAND CORNU FLARED HORN ANTENNA

BACKGROUND OF THE INVENTION

1. Field of the Invention

This invention generally pertains to horn antennas and more specifically to a horn antenna having an in-line balun connected to a cornu spiral flare.

2. Description of the Related Art

Good ultrawideband (UWB) antenna performance has been defined as relatively constant frequency-domain parameters such as impedance, pattern, gain, and polarization over at least 25 percent fractional bandwidth. The fractional bandwidth being defined by the upper frequency subtracted by the lower frequency and divided by the center frequency. From a time-domain perspective, good UWB performance can be defined as efficiently radiating or receiving a short pulse of electromagnetic energy with a small amount of signal distortion. Wideband efficiency is defined as the ratio of the total energy radiated to the total energy incident on the antenna, and is limited by energy reflected from the antenna back down the feed transmission line. See, Lamesdorf et al., *Baseband-Pulse-Antenna Techniques,* IEEE Ant. & Prop. Mag., Vol. 36, pp. 20–30, Jul. 1994. The amount of reflected voltage at a particular frequency is measured by a quantity called the voltage standing wave ratio (VSWR). A VSWR of 1.0 means no reflected voltage, whereas any value greater than 1.0 means energy that is reflected and therefore not radiated. Thus, a lower VSWR is almost always desirable. Ohmic, or heating, losses also hinder antenna efficiency, but in cases of antennas constructed only of highly conducting material, a high VSWR is normally a much more serious problem. In general, a good time-domain UWB antenna will also be a good frequency-domain antenna, but not necessarily vice-versa. For example, spiral antennas are noted for good UWB frequency-domain behavior and yet are poor UWB pulse antennas. Thus, it is necessary to evaluate time-domain UWB performance to demonstrate the antennas use in pulse applications. However, researchers have only recently investigated UWB antenna pulse behavior.

With the advent of large memory computers with fast processors, numerical modeling with time-domain Maxwell's equations algorithms such as the Finite-Difference Time-Domain (FDTD) method has led to the testing of antenna designs on computer platforms. See, Yee, *Numerical Solution of Initial Boundary Value Problems Involving Maxwell's Equations in Isotropic Media,* IEEE Trans. Antennas Propagat., Vol. 14, pp. 302–307, May 1966. Antenna designs based on FDTD calculations have been verified time and time again on antenna ranges.

Robertson and Morgan outlined the frequency-domain characteristics necessary for the transmission of a pulsed signal with no distortion. See, Robertson et al., *Ultra-wide-Band Impulse Antenna Study and Prototype Design,* Tech. Rpt. No. NPSEC-93-010, U.S. Navy Postgraduate School, Mar. 1993. These frequency independent characteristics include a complex conjugate match between the source impedance and the input impedance of the antenna, a constant gain over a preferred angular sector, and an effective height with a linear phase response, where the effective height is defined as the ratio of the open circuit receive voltage to the incident electric field. To receive a voltage that is a scaled replica of the incident field time-variation, an antenna should have a gain proportional to the square of the frequency as well as an effective height with a linear phase response. Because of the differing gain requirements on transmit and receive, it is not possible for a single antenna operating over a given pulse bandwidth to both radiate a far-zone field that is a scaled replica of the input voltage signal and to receive a voltage that is a scaled replica of the incident field. It is desirable, however, to achieve predictable antenna time-domain behavior.

Kraus points out that it is possible to deduce the qualitative behavior of an antenna from its appearance. See, Kraus, *Antennas,* McGraw-Hill, New York, N.Y., 2nd Ed., 1988. In particular, flared antennas which have a twin-conductor transmission line separation much less than a wavelength at the highest frequency, an aperture size greater than a wavelength at the lowest frequency, a constant characteristic impedance up to the aperture, and no discontinuities will tend to have wideband characteristics.

Transverse electromagnetic (TEM) horns are noted for high power wideband pulse performance. Most TEM horn antennas have a gain nearly proportional to the square of the frequency and thus the antenna will tend to transmit a far-zone field on the boresight that is nearly a scaled temporal derivative of the input voltage and receive a voltage that is nearly the scaled replica of the incident boresight field. Boresight is defined as the direction about which the antenna pattern is most symmetric. Flared horns, which contain TEM horns as a subclass, will also tend to transmit a field that is nearly a scaled temporal derivative of the input voltage signal on boresight and receive a voltage that is nearly a scaled replica of the boresight incident field. When implemented properly, the far zone fields have a broad angular distribution of significant radiated energy and high far-field fidelity, where fidelity in this case is defined as the degree to which the radiated fields are a scaled temporal derivative of the input voltage or the degree to which the received voltage is a scaled replica of the incident field.

FIG. 1 shows the salient features of a standard TEM linear flared-horn antenna. In this basic configuration, the antenna 10 is transverse-fed by a coaxial transmission line 12 TEM mode into the parallel-plate feed region 32. The plates 16 and 18 are transitioned at the feed to flare discontinuity 24 to the linear horn 34 flared out along the boresight direction 22 of radiation. The primary factors that affect the flared horn radiation of an UWB signal include the waveguide modes present in the feed region 32, the spatial point-to-point characteristic impedance of the transmission line 12, 32, and 34, the discontinuities 15 and 17 present at the aperture plane 28 and feed termination discontinuity 14 of the antenna, the flare taper shape and length 34, and the aperture size 28.

Several waveguide modes can exist in the parallel-plate feed region 32 of the antenna depending on the geometry and source fields, although the primary mode is the TEM mode. For the TEM mode, all frequency components will propagate down the waveguide at the same velocity, so they will tend to arrive at the flare region 34 in time synchronization. Higher order $TE_{On}$ and $TM_{On}$ modes travel down the waveguide at velocities that vary with frequency. As a consequence, if parallel plates 16 and 18 support $TE_{On}$ and $TM_{On}$ modes, the propagating signal will tend to distort. A parallel plate waveguide will cut off higher order mode propagation above the wavelengths given by the formula $$\lambda_{cutoff} = \frac{2S}{n},$$

where $\lambda_{cutoff}$ is the wavelength corresponding to the cutoff frequency, S is the plate separation 38 in the same units as $\lambda_{cutoff}$, and n is the mode number. See, Foster Ed., *Introduction to Ultra-Wideband Radar Systems,* Ch. 5, pp. 145–216, CRC Press, Inc., Ann Arbor, Mich., 1995. Thus to propagate only a TEM wave, the parallel plate waveguide should have a plate separation 38 no larger than one-half wavelength at the highest frequency component of the input signal. The width 36 of the parallel plates 16 and 18 sets the characteristic impedance and should be chosen for maximum or constant wideband energy transfer from the coaxial line 12.

The flare taper known as the cornu spiral has never been applied to flared horn antenna design. It has long been recognized by antenna designers that sharp geometrical discontinuities cause reflections that raise VSWR and thus constrain the amount of radiated energy. A cornu spiral is formed by parametrically plotting the scaled cosine Fresnel integral against the scaled sine Fresnel integral, and it has the unique property that the curvature of the flare increases linearly in proportion to the arc length of the flare. See, Jahnke et al., *Tables of Higher Functions,* McGraw-Hill N.Y., 6th ed., pp. 28–30, 1960. The cornu flare taper satisfies an important criteria in a wideband design, which is the notion of a smoothly varying geometrical change to limit diffraction and reflection. In addition the cornu flare arms spiral behind the aperture plane, so a sharp geometrical discontinuity at the aperture is avoided. By contrast, the TEM horn terminates abruptly at the aperture plane, which causes diffraction and reflection of waves, and raises VSWR.

SUMMARY OF THE INVENTION

The object of this invention is an antenna, for stand alone or array use, that efficiently radiates or receives high power ultrawideband electromagnetic waves over a preferred range of angles in space and transmits a far-zone field that is nearly the scaled temporal derivative of the input voltage and receives a voltage that is nearly a scaled replica of the incident field.

This and other objectives are accomplished by an inline coaxial balun fed cornu flared horn antenna. The antenna is formed by transitioning a coaxial line to a parallel-plate line with a Klopfenstein impedance profile (forming an inline-balun feed) and terminating with a flared horn antenna based on a cornu flared horn, which is formed by parametrically plotting the scaled cosine Fresnel integral versus the scaled sine Fresnel integral. The antenna has the unique property that the curvature of the flare increases linearly in proportion to the arc length of the flare. The Klopfenstein impedance profile ensures a low voltage reflection feed across a wide bandwidth with a minimum transition length which together with the cornu flare satisfies the requirements for a wideband design.

DESCRIPTION OF THE PREFERRED EMBODIMENT

Figure 1:
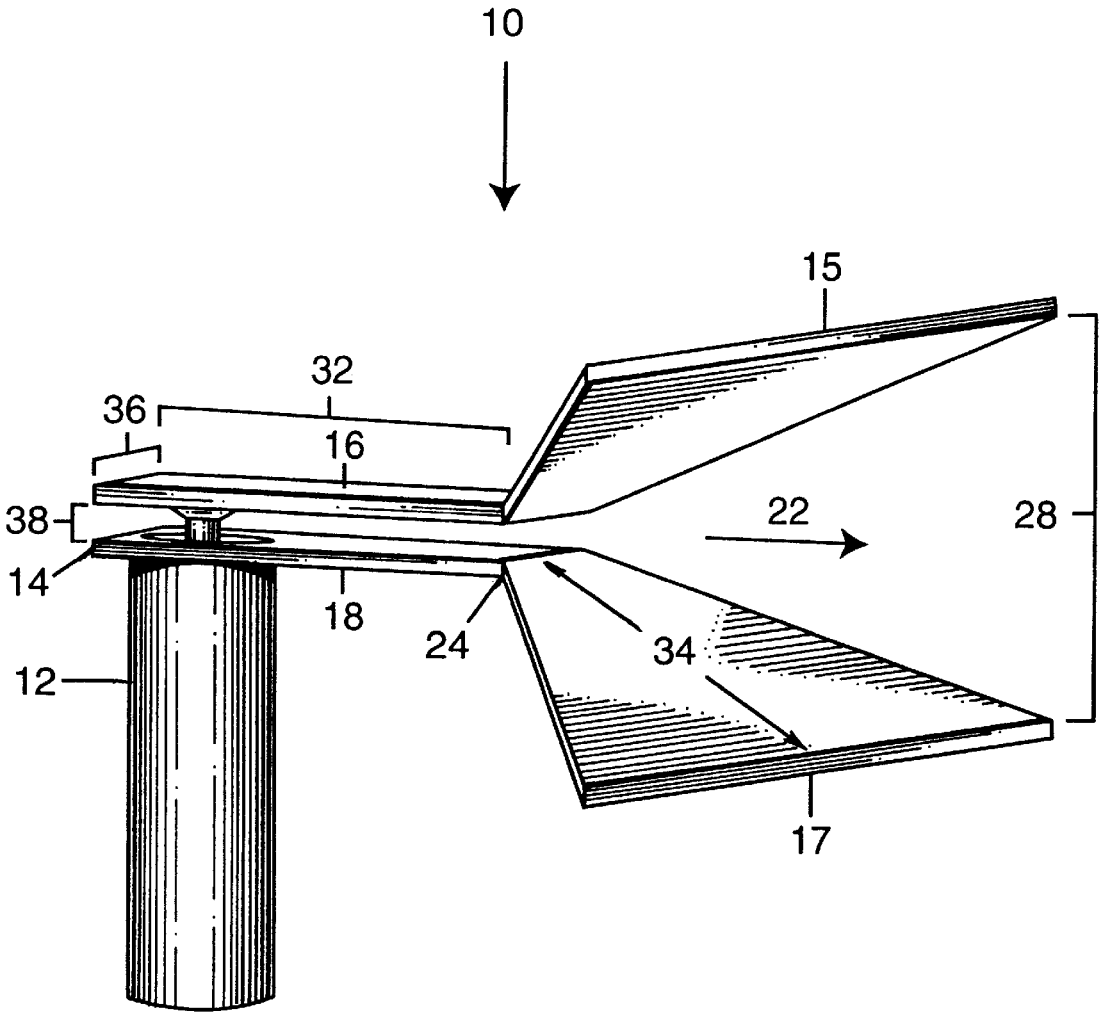
Prior Art FIG. 1
FIG. 1 shows a typical linear transverse electromagnetic (TEM) horn antenna.
Figure 2:
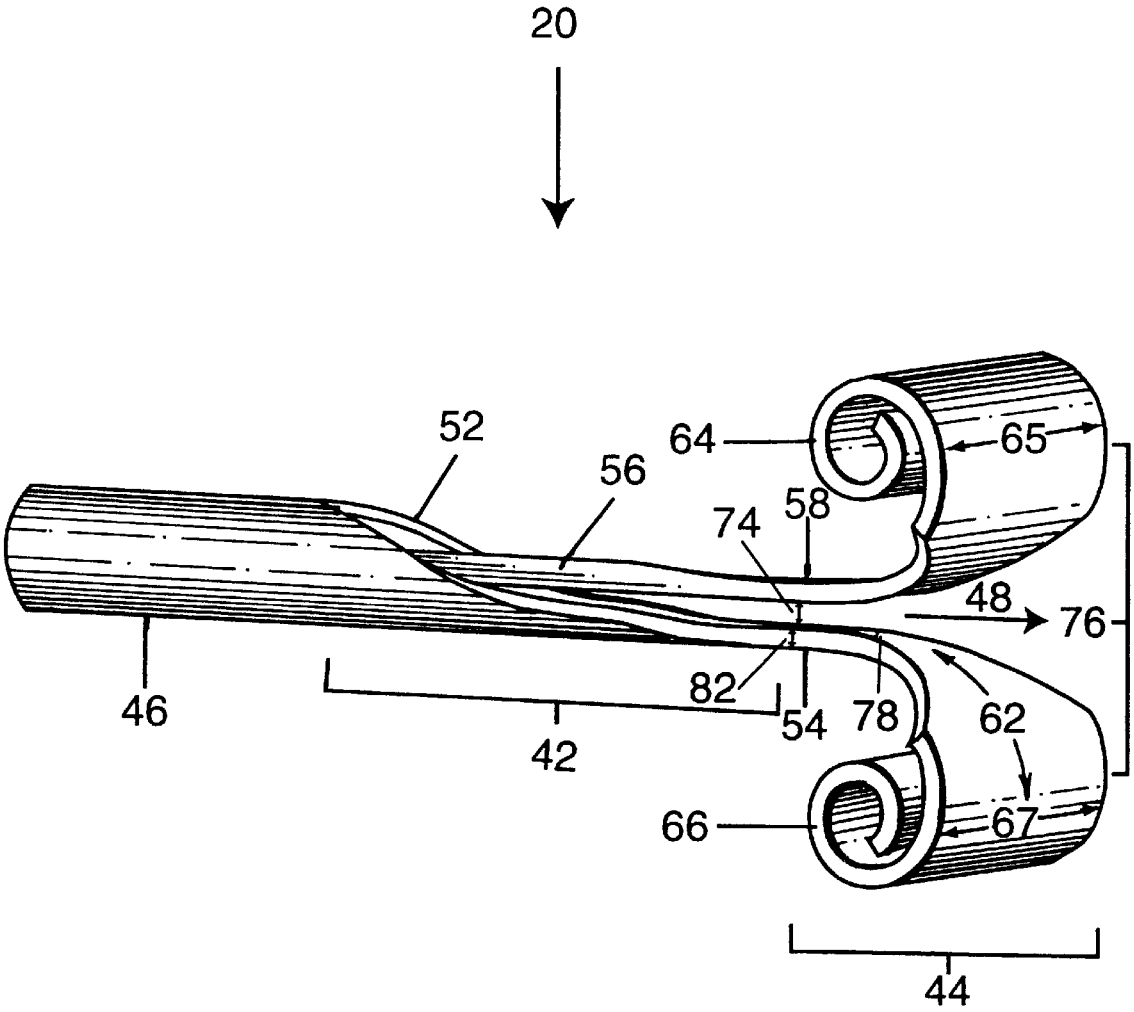
FIG. 2 shows an inline coaxial balun fed ultrawideband cornu flared horn antenna.

The inline coaxial balun fed ultrawideband cornu flared horn antenna 20, shown in FIG. 2, has two key aspects, a high power inline-balun 42 coax to parallel-plate transition and the curvature based cornu tapered flared horn antenna 44. The inline-balun 42 gets its name because the preferably circular coaxial feedline 46 is oriented inline with the boresight direction 48. The outer conductor 52 of the coaxial feedline 46 is gradually cut away until the outer conductor 52 is transitioned to a bottom parallel plate 54, whereas the center conductor 56 of the coaxial feedline 46 is transitioned to the top parallel plate 58. The parallel-plates have a higher impedance than the coaxial line 46, so an impedance transition with a Klopfenstein profile is employed to ensure low reflection wideband behavior with a minimum transition length. See, Duncan et al., 100:1 *Bandwidth Balun Transformer,* Proc. IRE, Vol 44, pp. 31–35, Jan. 1956, Foster et al., *A Wideband Balun from Coaxial Line to TEM Line,* IEE/URSI/UKRI 9th Inter. Conf. Antennas Propagat., pp. 286–290, Apr. 1995. Foster in England and Kolobov in Russia have applied inline-baluns to standard TEM horns. See, Kolobov et al., *An Ultrabroadband Microwave Antenna,* Telecommun. Radio Eng., Vol. 47, No. 1, pp. 113–115, 1991. The inline balun 42 has shown a small voltage standing wave ratio (VSWR) as a function of frequency and the inline orientation of the coaxial feedline 46 reduces the amount of transverse and back radiation from the antenna.

Charge acceleration is the sole cause of far-zone radiation. The three types of radiation mechanisms in antennas are charge oscillation about a fixed point, charge acceleration owing to charge accumulation at a discontinuity, and acceleration due to a change in trajectory. The cornu element relies on the third radiation mechanism. When properly designed and fed by the inline balun, the cornu flared horn 44 efficiently transmits far-zone fields that are nearly the scaled temporal derivative of the input voltage signal and receives an input voltage signal that is nearly the scaled replica of the incident boresight field.

The flare taper 62 known as the cornu spiral is formed by parametrically plotting the scaled cosine Fresnel integral against the scaled sine Fresnel integral, and it has the unique property that the curvature of the flare increases linearly in proportion to the arc length of the flare to cause a gradual acceleration of electrons. The electrons tend to accelerate more and more rapidly as they approach the aperture,and this increasing centripetal force on the electrons causes electromagnetic wavefronts to detach from the antenna 20. When the electrons reach the aperture plane, their aggregate energy has been diminished to such a level that radiation in directions significantly away from the boresight 48 is small. If the aggregate energy of the electrons at the upper and lower portions of the spirals is significant, then an electromagnetic absorbative material may be introduced near the spiral termination to reduce the energy level reflected back or radiated towards the feedline.

The cornu flare taper 62 satisfies an important criteria in wideband design, which is the proposition that a smoothly varying geometrical change limits diffraction and reflection. In addition the cornu flare arms 64 and 66 spiral behind the aperture plane, so a sharp geometrical discontinuity at the aperture 72 is avoided. The slot 52 formed by the Klopfenstein taper causes a residual component of the electromagnetic energy to radiate above the boresight direction. By flaring out the width of the plates 65 and 67 or increasing the thickness of the plates 82 this residual component is mitigated, thus forming a symmetrical distribution of energy in the E-plane far-zone of the antenna. The element is more effective if the widening or thickening of the flare plates 62 is done in such a way as to maintain the aspect ratio between the parallel-plate separation 74 to width 78 or thickness 82. In cases where flare plate widening or thickening is not possible, an asymmetrical cornu flare could produce a symmetrical E-plane energy pattern.

Proper design of the cornu elements 64 and 66 begins by specifying the parallel plate separation 74, which should be set at less than one-half wavelength at the highest ultrawideband (UWB) frequency to cut off all propagating modes except the transverse electromagnetic (TEM) mode, which is the only non-dispersive mode, and then scaling the cornu tapers so that the aperture size 76 is, preferably, at least one-half wavelength of the lowest UWB frequency. However, in practice it has been found that flared horns with apertures 76 sizes smaller than one-half wavelength at the lowest UWB frequency still have excellent performance. Preferably, the parallel plates 54 and 58 width 78 is approximately twice the diameter of the inner coaxial conductor 56, but as stated previously the plate width 78 can be increased in the flare region 44.

The cornu flare arms 64 and 66 are made of a non-magnetic conducting plates with rectangular (or other) cross-section formed into opposing cornu spirals, as shown in FIG. 2. The material may be coated or plated, by methods well known to those skilled in the art, with copper or any other conductive material such as platinum, gold, silver, etc.

Radiation mechanisms are entirely different between linear TEM horns and cornu flared horns. When fed by the inline balun, the linear TEM horn abruptly radiates nearly all of its energy from both the feed to flare discontinuity and the aperture discontinuity, whereas the cornu element gradually radiates energy owing to the curvature of the flare 62. Both the cornu flared horn 20 and the linear TEM horn radiate far-zone fields that are nearly the scaled temporal derivative of the input voltage signal and receive an input voltage signal that is nearly the scaled replica of the incident boresight field. However, the sharp aperture discontinuity present in the linear TEM horn design produces more late-time radiated fields than the cornu flared horn 20 in the boresight direction, and thus the linear TEM horn produces slightly more pulse stretching. The energy pattern of the cornu flared horn is broader than the linear TEM horn for the same effective flare angle, so the cornu is more useful in array applications that require beam steering. More importantly, the VSWR of the cornu element is superior to that of the linear horn across the frequency band because of the radiation mechanism employed. Designers have attempted to resistively load antennas with sharp aperture terminations to reduce the VSWR to acceptable levels, but the standard impedance tapers such as the Wu-King resistive loading method applied to dipoles leads to heating energy losses approaching 55 percent and reflection losses of 20 percent, whereas the unloaded cornu element has nearly zero heating losses, with the only lost energy being the small percentage reflected back down the coaxial line. See, Monda et al., *A Comparison of Several Broadband Loaded Monopoles for Pulse Radiation,* IEEE Antennas and Propagation Society International Symposium 1995, pp. 198–201, Jun. 1995. Capacitive loading has also been shown to degrade UWB performance in terms of a more distorted radiated field pulse. With the limitations imposed by loading, flare shaping should be the first design step, and this method led to the design of the cornu flared horn. Other shaped flares such as exponential taper have been applied to TEM horns, but the sharp aperture discontinuity present with such functions again leads to elevated VSWR.

Figure 3A:
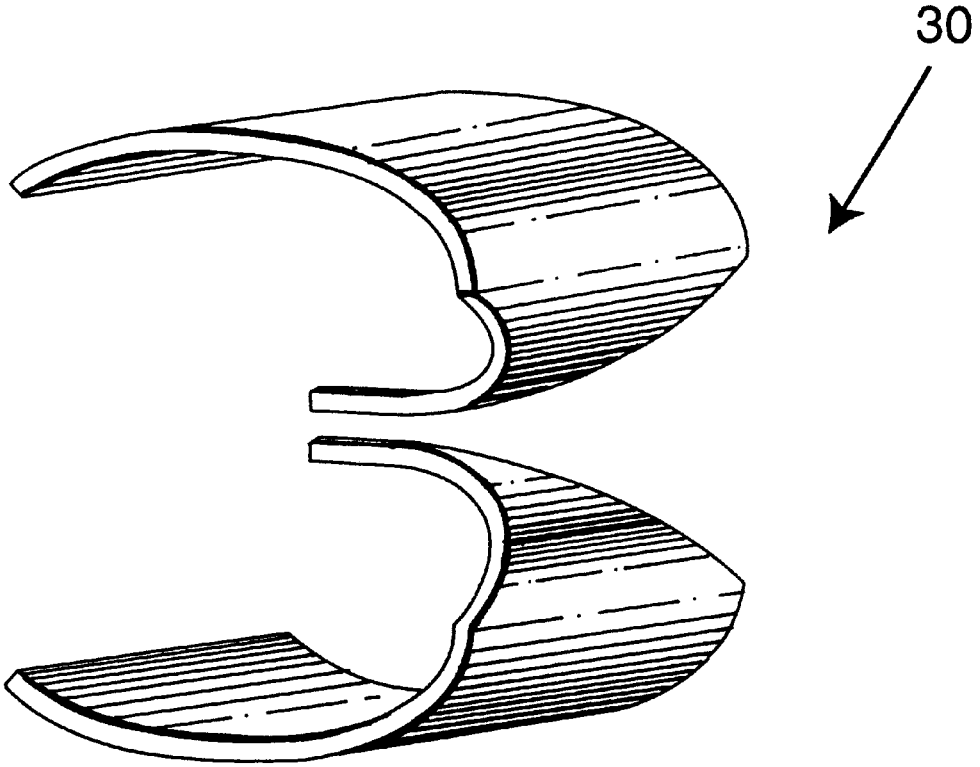
FIG. 3*a* shows a typical elliptical flared antenna element.
Figure 3B:
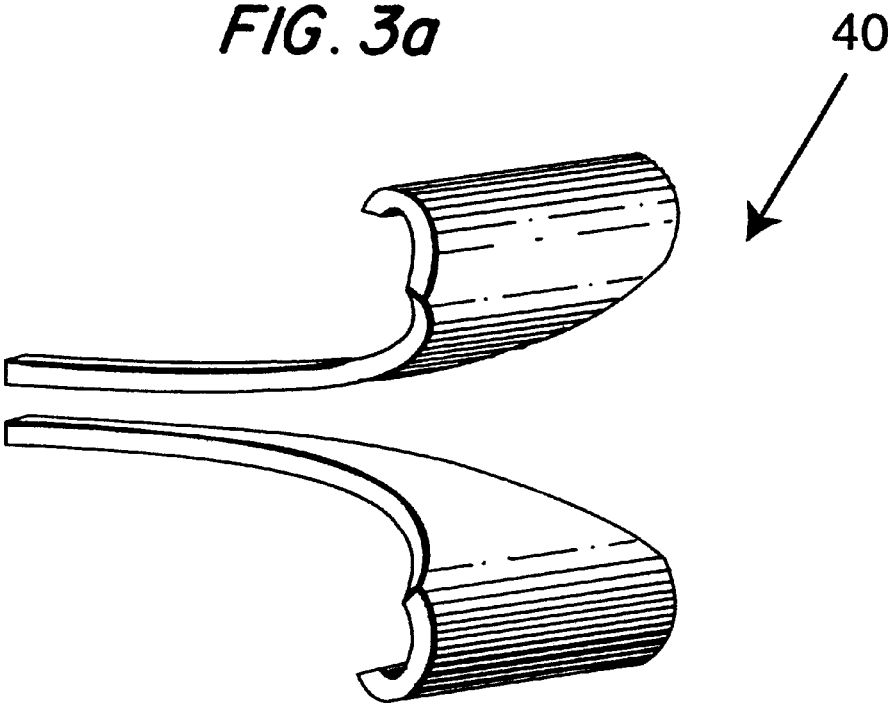
FIG. 3*b* shows a typical sici flared antenna element.

Although the cornu type antenna 20 appears to be the best antenna horn for pulsed UWB applications, it is possible to substitute other type flare tapers that have an absence of sharp aperture discontinuities. Two such tapers are the elliptical taper element 30, shown in FIG. 3*a,* and the sici taper element 40, shown in FIG. 3*b*. The elliptical taper element 30 is based on the ellipse, which has great flexibility in design but has a larger physical extent than the cornu antenna 20. The larger size becomes a limitation in array applications where half wavelength spacing may be required. The sici taper element 40, which like the cornu taper has never been applied to antenna flares, is obtained by parametrically plotting the scaled cosine integral against the scaled sine integral. See, Jahnke, supra. The sici taper element 40 has the property that the curvature increases exponentially in proportion to the arc length along the flare. It has the advantage of a smaller physical extent than the cornu type antenna 20, but its VSWR is slightly higher than the cornu type antenna 20.

This invention may be used as a stand alone antenna or in array applications and efficiently radiates and receives ultrawideband high power electromagnetic waves over a preferred range of angles in space. By avoiding sharp discontinuities, this invention avoids voltage breakdown and high VSWR, thereby allowing power levels far in excess of those in the prior art to be radiated over a ultrawide frequency bandwidth. The cornu design may also be made in a two-dimensional antenna form for low power applications by including the antenna on a microstrip or stripline circuit board. Although the cornu type antenna may be used as a stand alone antenna or as a phased array in radar applications, its utility is not limited to these configurations. It is possible to mold cornu type antennas into the hood of a vehicle to provide warning of approaching road hazards and other similar uses for air, sea and land transportation.

Although this invention has been described in relation to an exemplary embodiment thereof, it will be understood by those skilled in the art that still other variations and modifications can be affected in the preferred embodiment without detracting from the scope and spirit of the invention as described in the claims.

What is claimed is:

1. An antenna comprised of:

an inline balun formed by a coaxial transmission line having an inner and outer conductor that transitions to a parallel plate transmission line with a Klopfenstein impedance profile; and said antenna, having a cornu spiral flare with a curvature that increases linearly in proportion to the arc length of the flare, connected to said parallel plate transmission line wherein the flared antenna is capable of efficiently transmitting and receiving ultrawideband electromagnetic energy.

2. An antenna, as in claim 1, wherein the center conductor of the coaxial feedline is connected to a first side of the flared antenna and the outer conductor is connected to a second side of the flared antenna.

3. An antenna, as in claim 1, wherein the flared antenna is made of a non-magnetic conducting material.

4. An antenna, as in claim 1, wherein the non-magnetic material is coated with a conductive material.

5. An antenna, as in claim 3, wherein said first and second sides of the parallel plates and flares are rectangular in cross-section.

6. An antenna, as in claim 3, wherein said first and second sides of the flared antenna are flared.

7. An antenna comprising:

an inline balun formed by a coaxial transmission line having an inner and outer conductor that transitions to a parallel plate transmission line with a Klopfenstein impedance profile; and said antenna, having a cornu spiral flare with a curvature that increases linearly in proportion to the arc length of the flare, connected to said parallel plate transmission line wherein the flared antenna is capable of efficiently transmitting and receiving ultrawideband electromagnetic energy;

wherein the center conductor of the coaxial feedline is connected to a first side of the flared antenna and the outer conductor is connected to a second side of the flared antenna.

8. An antenna comprising:

an inline balun formed by a coaxial transmission line having an inner and outer conductor that transitions to a parallel plate transmission line in a Klopfenstein impedance profile; and said antenna, having a cornu spiral flare with a first and second side with a curvature that increases linearly in proportion to the arc length of the flare, connected to said parallel plate transmission line wherein the flared antenna is capable of efficiently transmitting and receiving ultrawideband electromagnetic energy;

said first and second sides of the flared antenna being flared.

9. An antenna comprising:

An inline balum formed by a coaxial transmission line haviung an iner and outer conductor that transitions to a paralel plate transmission linre with a Klopfenstein impedance profile; and said antenna, having a sici spiral flare with a curvature that increases linearly in proportion to the arc length of the flare, connected to said parallel plate transmission line.

* * * * *

UNITED STATES PATENT AND TRADEMARK OFFICE

CERTIFICATE OF CORRECTION

PATENT NO. : 5,973,653
DATED : October 26, 1999
INVENTOR(S) : Mark Kragalott and William Pala It is certified that error appears in the above-identified patent and that said Letters Patent is hereby corrected as shown below:

Column 8,
Delete lines 11 through 19.

Column 8,
Insert the following:

9. An antenna comprising:
an inline balun formed by a coaxial transmission line having an inner and outer conductor that transitions to a parallel plate transmission line in a Klopfenstein impedance profile; and
said antenna, having a cornu spiral flare with a first and second side with a curvature that increases linearly in proportion to the arc length of the flare, connected to said parallel plate transmission line wherein the flared antenna is capable of efficiently transmitting and receiving ultrawideband electromagnetic energy;
said first and second sides of the flared antenna being flared.

10. An antenna comprising:
an inline balun formed by a coaxial transmission line having an inner and outer conductor that transitions to a parallel plate transmission line with a Klopfenstein impedance profile; and
said antenna, having a sici spiral flare with a curvature that increases linearly in proportion to the arc length of the flare connected to said parallel plate transmission line.

Signed and Sealed this

Eighteenth Day of December, 2001

*Attest:*

*Attesting Officer*

JAMES E. ROGAN
*Director of the United States Patent and Trademark Office*